US009908670B2

(12) United States Patent
Patel et al.

(10) Patent No.: US 9,908,670 B2
(45) Date of Patent: Mar. 6, 2018

(54) CONTAINER FOR SMOKELESS TOBACCO PRODUCTS

(75) Inventors: Pankaj Patel, Clemmons, NC (US); Timothy Frederick Thomas, High-Point, NC (US); William Michael Jones, Atoka, TN (US)

(73) Assignee: American Snuff Company, LLC, Memphis, TN (US)

( * ) Notice: Subject to any disclaimer, the term of this patent is extended or adjusted under 35 U.S.C. 154(b) by 119 days.

(21) Appl. No.: 13/017,325

(22) Filed: Jan. 31, 2011

(65) Prior Publication Data

US 2012/0193265 A1 Aug. 2, 2012

(51) Int. Cl.

| | |
|---|---|
| ***B65D 51/16*** | (2006.01) |
| ***A24F 23/00*** | (2006.01) |
| ***B65D 43/02*** | (2006.01) |

(52) U.S. Cl.

CPC ..... *B65D 51/1627* (2013.01); *A24F 23/00* (2013.01); *B65D 43/0222* (2013.01); *B65D 2543/00092* (2013.01); *B65D 2543/00277* (2013.01); *B65D 2543/00527* (2013.01); *B65D 2543/00537* (2013.01)

(58) Field of Classification Search

USPC ..... 220/796; 206/265

See application file for complete search history.

(56) References Cited

U.S. PATENT DOCUMENTS

| | | | |
|---|---|---|---|
| 194,197 | A | 8/1877 | Villaret |
| 1,464,237 | A | 8/1923 | Beyer |
| 2,090,530 | A | 8/1937 | Guffey et al. |
| 2,117,228 | A | 5/1938 | Stuchbery |
| 2,403,511 | A | 7/1946 | Enkur |
| 3,696,917 | A | 10/1972 | Levi |
| 3,782,584 | A | 1/1974 | Swenson et al. |

(Continued)

FOREIGN PATENT DOCUMENTS

| | | | |
|---|---|---|---|
| CH | 180218 | A | 10/1935 |
| CN | 1143350 | A | 2/1997 |

(Continued)

OTHER PUBLICATIONS

International Search Report and Written Opinion for International Application No. PCT/US2012/023100 dated May 14, 2012.

*Primary Examiner* — Jeffrey Allen
*Assistant Examiner* — Jennifer Castriotta
(74) *Attorney, Agent, or Firm* — Womble Bond Dickinson (US) LLP

(57) ABSTRACT

A container adapted for storing a product is provided. The container includes a body having a bottom wall and a side wall. The bottom wall and the side wall define an internal storage compartment adapted for storage of a plurality of units of a product. The side wall has an outer peripheral surface. A rib structure is engaged with the body about the outer peripheral surface of the side wall and extends outwardly therefrom. A cover is configured to be removably engaged with the body. The cover includes a top wall and a peripheral flange having an inner surface. The inner surface is substantially smooth and is configured to interact with the rib structure when the cover is received over the outer peripheral surface of the side wall so as to form an interference fit.

16 Claims, 4 Drawing Sheets

(56) References Cited

U.S. PATENT DOCUMENTS

| | | | |
|---|---|---|---|
| 3,895,737 | A | 7/1975 | Phillips |
| B536,923 | I5 | 3/1976 | Mayled |
| 4,057,145 | A | 11/1977 | Wray et al. |
| 4,098,421 | A | 7/1978 | Foster |
| 4,154,365 | A | 5/1979 | Lorca |
| 4,190,170 | A | 2/1980 | Boyd |
| 4,284,204 | A | 8/1981 | Carey, Jr. |
| 4,437,579 | A | 3/1984 | Obland |
| 4,561,544 | A | 12/1985 | Reeve |
| 4,572,376 | A | 2/1986 | Wrennall |
| 4,607,479 | A | 8/1986 | Linden |
| 4,611,727 | A | 9/1986 | Graff |
| 4,631,899 | A | 12/1986 | Nielsen |
| 4,646,933 | A | 3/1987 | Jurczenia et al. |
| 4,705,165 | A | 11/1987 | Thieke |
| 5,108,006 | A | 4/1992 | Tieke et al. |
| 5,174,471 | A | 12/1992 | Kozlowski et al. |
| 5,275,291 | A | 1/1994 | Sledge |
| 5,443,853 | A | 8/1995 | Hayes |
| 5,657,901 | A | 8/1997 | Farside |
| 5,660,290 | A | 8/1997 | Hayes |
| 5,729,955 | A | 3/1998 | Yamada |
| 5,782,359 | A | 7/1998 | McAllister et al. |
| 5,816,441 | A | 10/1998 | Farside |
| 5,897,025 | A | 4/1999 | Flewitt et al. |
| 5,909,822 | A | 6/1999 | George et al. |
| 5,915,560 | A | 6/1999 | George et al. |
| 6,032,792 | A | 3/2000 | Faraj |
| 6,131,765 | A | 10/2000 | Barry et al. |
| 6,155,454 | A | 12/2000 | George et al. |
| 6,162,516 | A | 12/2000 | Derr |
| 6,267,265 | B1 | 7/2001 | Issa |
| 6,460,693 | B1 | 10/2002 | Harrold |
| 6,527,138 | B2 | 3/2003 | Pawlo et al. |
| 6,758,338 | B2 | 7/2004 | Lien |
| D495,545 | S | 9/2004 | Niehues |
| 6,863,175 | B2 | 3/2005 | Gelardi |
| 6,913,149 | B2 | 7/2005 | Gelardi et al. |
| 6,976,576 | B2 | 12/2005 | Intini |
| 7,159,720 | B2 | 1/2007 | Pearson |
| 7,216,776 | B2 | 5/2007 | Gelardi |
| 7,288,745 | B2 | 10/2007 | Colonna |
| 7,353,969 | B2 | 4/2008 | McHutchinson |
| 7,565,969 | B2 | 7/2009 | He |
| 7,588,149 | B2 | 9/2009 | Gelardi |
| 7,712,630 | B2 | 5/2010 | He |
| 7,798,319 | B1 | 9/2010 | Bried et al. |
| D631,353 | S | 1/2011 | Gelardi et al. |
| D631,354 | S | 1/2011 | Gelardi et al. |
| D631,747 | S | 2/2011 | Gelardi et al. |
| D646,966 | S | 10/2011 | Gill et al. |
| 2001/0047977 | A1 | 12/2001 | Forman |
| 2002/0096517 | A1 | 7/2002 | Gelardi |
| 2002/0175195 | A1 | 11/2002 | Cole |
| 2004/0217024 | A1 | 11/2004 | Arnarp et al. |
| 2005/0173272 | A1 | 8/2005 | Lemmons, IV |
| 2006/0060480 | A1 | 3/2006 | Budd |
| 2006/0118589 | A1 | 6/2006 | Arnarp et al. |
| 2006/0124658 | A1 | 6/2006 | Coe et al. |
| 2006/0243611 | A1 | 11/2006 | Wu |
| 2007/0068960 | A1 | 3/2007 | Valentine et al. |
| 2007/0102318 | A1 | 5/2007 | Gelardi et al. |
| 2007/0110928 | A1 | 5/2007 | Bried et al. |
| 2007/0163911 | A1 | 7/2007 | Gelardi |
| 2007/0277299 | A1 | 12/2007 | Kroon |
| 2008/0035643 | A1 | 2/2008 | Hoffman et al. |
| 2008/0290110 | A1 | 11/2008 | Gelardi et al. |
| 2009/0014450 | A1 | 1/2009 | Bjorkholm |
| 2009/0223989 | A1 | 9/2009 | Gelardi |
| 2009/0266837 | A1 | 10/2009 | Gelardi et al. |
| 2010/0018882 | A1 | 1/2010 | St. Charles |
| 2010/0018883 | A1* | 1/2010 | Patel ..... 206/256 |
| 2010/0059539 | A1 | 3/2010 | Giraud et al. |
| 2010/0065076 | A1 | 3/2010 | Bergstrom et al. |
| 2010/0065077 | A1 | 3/2010 | Lofgreen-Ohrn et al. |
| 2010/0084424 | A1 | 4/2010 | Gelardi |
| 2010/0133140 | A1 | 6/2010 | Bailey et al. |
| 2010/0264157 | A1 | 10/2010 | Bailey et al. |
| 2010/0307113 | A1 | 12/2010 | Bried et al. |

FOREIGN PATENT DOCUMENTS

| | | | |
|---|---|---|---|
| CN | 101111165 | A | 1/2008 |
| DE | 539200 | C | 11/1931 |
| GB | 686 870 | A | 2/1953 |
| GB | 2 042 476 | A | 9/1980 |
| WO | WO 1999/48391 | A1 | 9/1999 |
| WO | WO 03/000566 | | 1/2003 |
| WO | WO 2004/035404 | A1 | 4/2004 |
| WO | WO 2005/035390 | A1 | 4/2005 |
| WO | WO 2007/017761 | A2 | 2/2007 |
| WO | WO 2007/067953 | A2 | 6/2007 |
| WO | WO 2008/070032 | A2 | 6/2008 |
| WO | 2010060723 | | 6/2010 |
| WO | 2010066510 | | 6/2010 |

* cited by examiner

CONTAINER FOR SMOKELESS TOBACCO PRODUCTS

FIELD OF THE DISCLOSURE

The present disclosure relates to containers and methods of use thereof. More particularly, the disclosure relates to packaging for products made or derived from tobacco, or that otherwise incorporate tobacco, and are intended for human consumption in a smokeless form.

BACKGROUND OF THE DISCLOSURE

Various types of containers for dispensing solid objects, particularly solid products intended for human consumption, are known in the art. Such containers are often characterized by a hand-held size that can be easily stored and transported. Exemplary consumable products that are often packaged in such containers include a wide variety of consumer products, including smokeless tobacco-related products.

Tobacco may be enjoyed in a so-called "smokeless" form. Particularly popular smokeless tobacco products are employed by inserting some form of processed tobacco or tobacco-containing formulation into the mouth of the user. See for example, the types of smokeless tobacco formulations, ingredients, and processing methodologies set forth in U.S. Pat. No. 1,376,586 to Schwartz; U.S. Pat. No. 3,696,917 to Levi; U.S. Pat. No. 4,513,756 to Pittman et al.; U.S. Pat. No. 4,528,993 to Sensabaugh, Jr. et al.; U.S. Pat. No. 4,624,269 to Story et al.; U.S. Pat. No. 4,991,599 to Tibbetts; U.S. Pat. No. 4,987,907 to Townsend; U.S. Pat. No. 5,092,352 to Sprinkle, III et al.; U.S. Pat. No. 5,387,416 to White et al.; U.S. Pat. No. 6,668,839 to Williams; U.S. Pat. No. 6,834,654 to Williams; U.S. Pat. No. 6,953,040 to Atchley et al.; U.S. Pat. No. 7,032,601 to Atchley et al.; U.S. Pat. No. 7,694,686 to Atchley et al.; U.S. Pat. No. 7,810,507 to Dube et al.; U.S. Pat. No. 7,819,124 to Strickland et al.; and U.S. Pat. No. 7,861,728 to Holton, Jr. et al.; U.S. Pat. Pub. Nos. 2004/0020503 to Williams; 2005/0115580 to Quinter et al.; 2005/0244521 to Strickland et al.; 2006/0191548 to Strickland et al.; 2007/0062549 to Holton, Jr. et al.; 2008/0029116 to Robinson et al.; 2008/0029117 to Mua et al.; 2008/0173317 to Robinson et al.; 2008/0196730 to Engstrom et al.; 2008/0209586 to Neilsen et al.; 2008/0305216 to Crawford et al.; 2009/0065013 to Essen et al.; 2009/0293889 to Kumar et al.; and 2010/0291245 to Gao et al.; PCT Pub. Nos. WO 04/095959 to Arnarp et al.; and WO 10/132,444 to Atchley; each of which is incorporated herein by reference.

Representative smokeless tobacco products that have been marketed include those referred to as CAMEL Snus, CAMEL Orbs, CAMEL Strips and CAMEL Sticks by R. J. Reynolds Tobacco Company; GRIZZLY moist tobacco, KODIAK moist tobacco, LEVI GARRETT loose tobacco and TAYLOR'S PRIDE loose tobacco by American Snuff Company, LLC; KAYAK moist snuff and CHATTANOOGA CHEW chewing tobacco by Swisher International, Inc.; REDMAN chewing tobacco by Pinkerton Tobacco Co. LP; COPENHAGEN moist tobacco, COPENHAGEN Pouches, SKOAL Bandits, SKOAL Pouches, RED SEAL long cut and REVEL Mint Tobacco Packs by U.S. Smokeless Tobacco Company; and MARLBORO Snus and Taboka by Philip Morris USA.

Representative types of snuff products, commonly referred to as "snus," are manufactured in Europe, particularly in Sweden, by or through companies such as Swedish Match AB, Fiedler & Lundgren AB, Gustavus AB, Skandinavisk Tobakskompagni A/S and Rocker Production AB.

Snus products available in the U.S.A. are marketed under the trade names such as CAMEL Snus Frost, CAMEL Snus Original and CAMEL Snus Spice by R. J. Reynolds Tobacco Company.

Snus products, such as CAMEL Snus Original, are commonly supplied in small teabag-like pouches. The pouches are typically a nonwoven fleece material, and contain about 0.4 to 1.5 grams of pasteurized tobacco. These products typically remain in a user's mouth for about 10-30 minutes. Unlike certain other smokeless tobacco products, snus does not require expectoration by the user.

Snus products have been packaged in tins, "pucks" or "pots" that are manufactured from metal or plastic such as those disclosed in U.S. Pat. No. 4,098,421 to Foster and U.S. Pat. No. 4,190,170 to Boyd, and U.S. Patent Pub. Nos. 2010/0065076 to Bergstrom et al.; and 2010/0065077 to Lofgreen-Ohrn et al.; each of which is incorporated by reference herein.

A desirable feature for certain containers is the protection of the product from environmental effects, particularly those effects that may degrade the product stored in the container. For example, in humid environments, moisture may invade the storage space housing the product, thereby damaging the product or otherwise rendering the product unusable. In other instances, venting within the enclosure formed by the container may be needed for properly storing a product.

It would thus be desirable to provide an improved packaging for smokeless tobacco products and the like, wherein the packaging is aesthetically pleasing and provides various advantageous features, such as protection from environmental effects by venting the container.

BRIEF SUMMARY OF THE DISCLOSURE

The present disclosure provides a container that, in certain embodiments, combines aesthetics and environmental protection of a product, and which can be provided in a convenient handheld size. The type and form of the product to be stored can vary.

In one embodiment, the container of the disclosure comprises a body having a bottom wall and a side wall. The bottom wall and the side wall define an internal storage compartment adapted for storage of a plurality of units of a product. The side wall has an outer peripheral surface. A rib structure is engaged with the body about the outer peripheral surface of the side wall and extends outwardly therefrom. A cover is configured to be removably engaged with the body. The cover includes a top wall and a peripheral flange having an inner surface. The inner surface is substantially smooth and is configured to interact with the rib structure when the cover is received over the outer peripheral surface of the side wall so as to form an interference fit.

In another aspect, the disclosure provides a container comprising a polymeric body having a bottom wall and a cylindrical side wall. The bottom wall and the side wall define an internal storage compartment adapted for storage of a plurality of units of a product. The side wall has an outer peripheral surface. A circumferential rib structure is integrally formed with the polymeric body about the outer peripheral surface of the side wall and extends radially outwardly therefrom. The rib structure comprising a plurality of ribs extending circumferentially about the outer peripheral surface of the side wall. The ribs are spaced apart so as to form channels therebetween for facilitating venting. A metallic cover is configured to be removably engaged with the polymeric body. The metallic cover includes a top wall and a peripheral flange having a cylindrical inner surface.

The cylindrical inner surface is substantially smooth and is configured to interact with the rib structure when the metallic cover is received over the outer peripheral surface of the side wall so as to form an interference fit.

In yet another aspect, the disclosure provides a polymeric body having a bottom wall and a cylindrical side wall having an edge. The bottom wall and the side wall define an internal storage compartment adapted for storage of a plurality of units of a product. The internal storage compartment has an opening thereto adjacent to the edge of the side wall, wherein an outer peripheral surface of the side wall comprises a neck region of reduced diameter proximal to the edge of the side wall such that the side wall defines a lip. A circumferential rib structure is integrally formed with the polymeric body about the outer peripheral surface of the side wall in the neck region and projects radially outwardly therefrom. The rib structure includes a plurality of rib segments extending circumferentially about the outer peripheral surface of the side wall. The rib segments are spaced apart so as to form vent channels therebetween and each rib segment includes a rib wall projecting radially from the outer peripheral surface of the body and a rib projection projecting radially from the rib wall. Each vent channel is at least partially defined by adjacent rib walls and the outer peripheral surface of the side wall of the body. A metallic cover is configured to be removably engaged with the polymeric body. The metallic cover has a top wall and a peripheral flange having a cylindrical inner surface. The cylindrical inner surface is substantially smooth and is configured to interact with the rib structure when the metallic cover is received over the neck region of the side wall so as to form an interference fit, and wherein the metallic cover is configured to abut the lip of the side wall of the body when the metallic cover is fully seated on the body.

These and other features, aspects, and advantages of the disclosure will be apparent from a reading of the following detailed description together with the accompanying drawings, which are briefly described below.

BRIEF DESCRIPTION OF THE DRAWINGS

Figure 1:
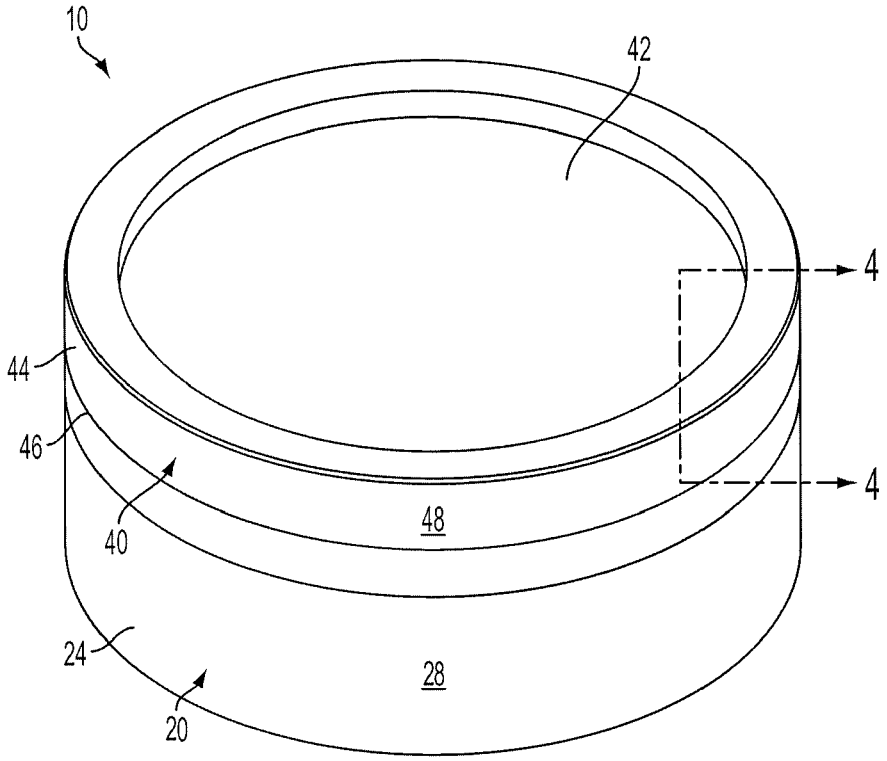
Figure 2:
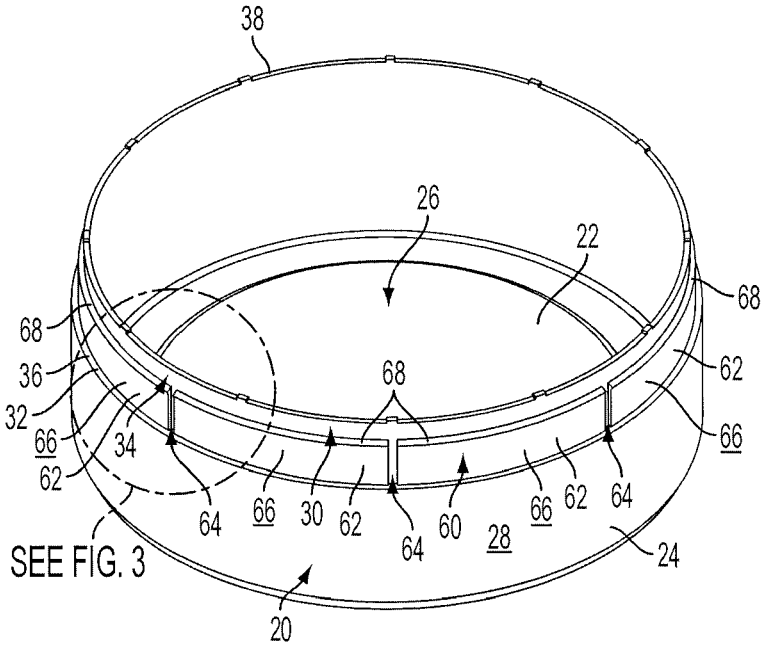
Figure 3:
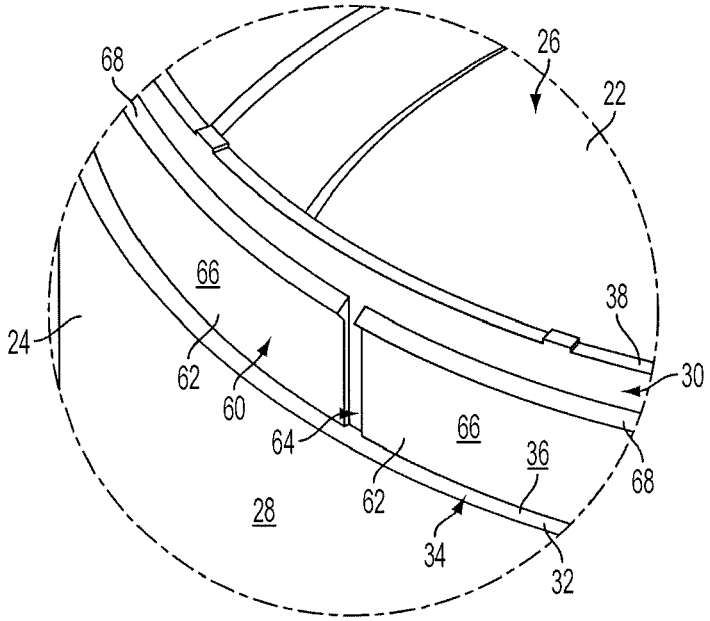

Having thus described the disclosure in general terms, reference will now be made to the accompanying drawings, which are not necessarily drawn to scale, and wherein:

FIG. 1 is a perspective view of a container embodiment of the present disclosure;

FIG. 2 is a perspective view of a body of a container embodiment according to the present disclosure;

FIG. 3 is a magnified view of a portion of the body of FIG. 2; and

Figure 4:
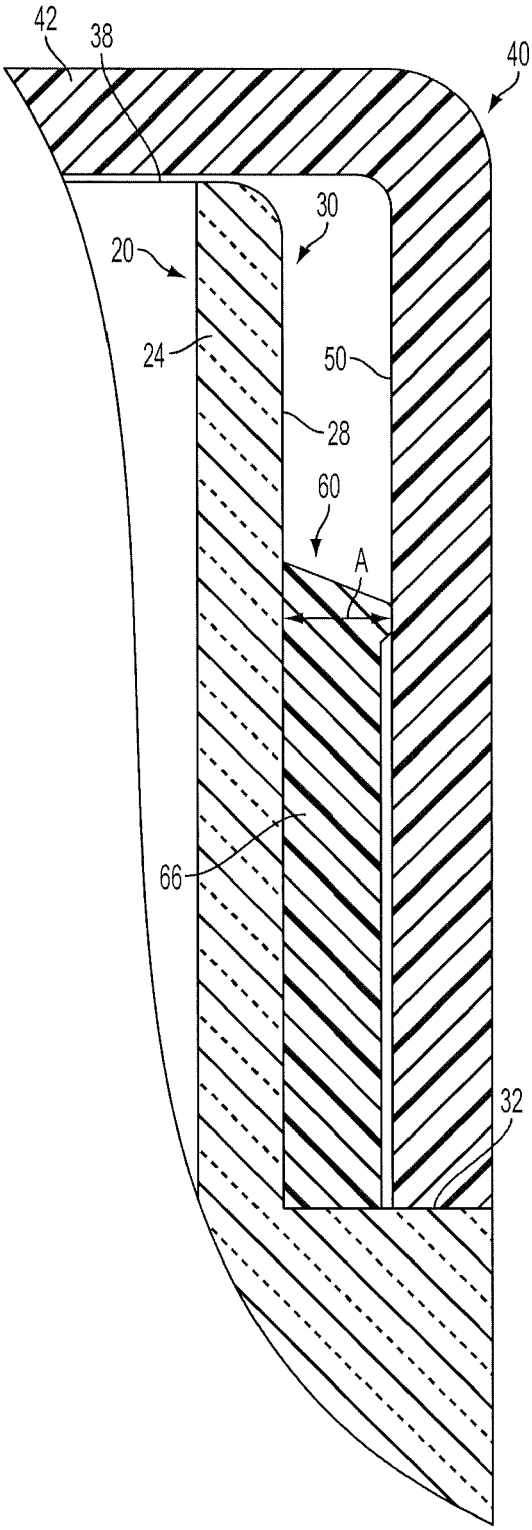

FIG. 4 is a magnified sectional view on the line 4-4 of FIG. 1.

DETAILED DESCRIPTION OF THE DISCLOSURE

The present disclosure now will be described more fully hereinafter with reference to certain preferred aspects. These aspects are provided so that this disclosure will be thorough and complete, and will fully convey the scope of the disclosure to those skilled in the art. Indeed, the disclosure may be embodied in many different forms and should not be construed as limited to the aspects set forth herein; rather, these aspects are provided so that this disclosure will satisfy applicable legal requirements. As used in the specification, and in the appended claims, the singular forms "a", "an", "the", include plural referents unless the context clearly dictates otherwise.

The container embodiments described in the present application can be used to store any solid products, but are particularly well-suited for products designed for oral consumption. Exemplary consumable products that are often packaged in such containers include a wide variety of consumer products, including tobacco products in smokeless form.

Exemplary tobacco products include pelletized tobacco products (e.g., compressed or molded pellets produced from powdered or processed tobacco, such as those formed into the general shape of a coin, cylinder, bean, pellet, sphere, orb, strip, obloid, cube, bead, or the like), extruded or cast pieces of tobacco (e.g., as strips, films or sheets, including multilayered films formed into a desired shape), products incorporating tobacco carried by a solid substrate (e.g., where substrate materials range from edible grains to inedible cellulosic sticks), extruded or formed tobacco-containing rods or sticks, tobacco-containing capsule-like materials having an outer shell region and an inner core region, straw-like (e.g., hollow formed) tobacco-containing shapes, sachets or packets containing tobacco (e.g., snus-like products), pieces of tobacco-containing gum, and the like. Further, exemplary tobacco products include tobacco formulations in a loose form such as, for example, a moist snuff product. Exemplary loose form tobacco used with the containers of the present disclosure may include tobacco formulations associated with, for example, commercially available GRIZZLY moist tobacco products and KODIAK moist tobacco products that are marketed by American Snuff Company, LLC.

Exemplary smokeless tobacco compositions that can be packaged in the containers of the present disclosure are set forth in, for example, U.S. Pat. No. 1,376,586 to Schwartz; U.S. Pat. No. 3,368,567 to Speer; U.S. Pat. No. 4,513,756 to Pittman et al.; U.S. Pat. No. 4,606,357 to Dusek et al; U.S. Pat. No. 4,821,749 to Toft et al.; U.S. Pat. No. 5,167,244 to Kjerstad; U.S. Pat. No. 5,387,416 to White; U.S. Pat. No. 6,668,839 to Williams; U.S. Pat. No. 7,810,507 to Dube et al.; U.S. Pat. No. 7,819,124 to Strickland et al.; U.S. Patent Pub. Nos. 2005/0244521 to Strickland et al.; 2006/0191548 to Strickland et al.; and 2008/0029116 to Robinson et al. Examples of tobacco-containing gum are set forth in U.S. Pat. No. 4,624,269 to Story et al.; U.S. Pat. No. 4,975,270 to Kehoe; and U.S. Pat. No. 4,802,498 to Ogren. Various manners or methods for packaging smokeless tobacco products are set forth in U.S. Patent Pub. Nos. 2004/0217024 and 2006/0118589 to Arnarp et al.; and 2009/0014450 to Bjorkholm; and PCT Pub. Nos. WO 2006/034450 to Budd; WO 2007/017761 to Kutsch et al.; and WO 2007/067953 to Sheveley et al. All of the above-cited references are incorporated by reference herein in their entirety.

Smokeless tobacco compositions utilized as the product contained in the containers of the disclosure will often include such ingredients as tobacco (typically in particulate form), sweeteners, binders, colorants, pH adjusters, fillers, flavoring agents, disintegration aids, antioxidants, oral care additives, and preservatives. See, for example, U.S. Pat. No. 7,861,728 to Holton et al., which is incorporated by reference herein in its entirety.

The tobacco formulation can be contained within a container, such as a pouch or bag, such as is the type commonly used for the manufacture of snus types of products (e.g., a sealed, moisture permeable pouch that is sometimes referred to as a "portion"). A representative moisture permeable pouch can be composed of a "fleece" type of material. The tobacco formulation is in turn contained within a package, such as the containers of the present disclosure described more fully hereinbelow. The package is sealed tightly, and is composed of a suitable material, such that the atmospheric conditions within that sealed package are modified and/or controlled. That is, the sealed package can provide a good barrier that inhibits the passage of compositions such as moisture and oxygen therethrough. In addition, the atmosphere within the sealed package can be further modified by introducing a selected gaseous species (e.g., nitrogen, argon, or a mixture thereof) into the package prior to sealing or by drawing a vacuum therein (vacuum sealing). As such, the atmospheric conditions to which the tobacco composition is exposed are controlled during conditions of preparation, packing, storage and handling.

An exemplary pouch may be manufactured from materials, and in such a manner, such that during use by the user, the pouch undergoes a controlled dispersion or dissolution. Such pouch materials may have the form of a mesh, screen, perforated paper, permeable fabric, or the like. For example, pouch material manufactured from a mesh-like form of rice paper, or perforated rice paper, may dissolve in the mouth of the user. As a result, the pouch and tobacco formulation each may undergo complete dispersion within the mouth of the user during normal conditions of use, and hence the pouch and tobacco formulation both may be ingested by the user. Other exemplary pouch materials may be manufactured using water dispersible film forming materials (e.g., binding agents such as alginates, carboxymethylcellulose, xanthan gum, pullulan, and the like), as well as those materials in combination with materials such as ground cellulosics (e.g., fine particle size wood pulp). Preferred pouch materials, though water dispersible or dissolvable, may be designed and manufactured such that under conditions of normal use, a significant amount of the tobacco formulation contents permeate through the pouch material prior to the time that the pouch undergoes loss of its physical integrity. If desired, flavoring ingredients, disintegration aids, and other desired components, may be incorporated within, or applied to, the pouch material. Descriptions of various components of snus products and components thereof also are set forth in U.S. Pat. Pub. No. 2004/0118422 to Lundin et al., which is incorporated herein by reference. See, also, for example, U.S. Pat. No. 4,607,479 to Linden; U.S. Pat. No. 4,631,899 to Nielsen; U.S. Pat. No. 5,346,734 to Wydick et al.; and U.S. Pat. No. 6,162,516 to Derr, and U.S. Pat. Pub. No. 2005/0061339 to Hansson et al.; each of which is incorporated herein by reference. See, also, the representative types of pouches, and pouch material or fleece, set forth in U.S. Pat. No. 5,167,244 to Kjerstad, which is incorporated herein by reference. Snus products can be manufactured using equipment such as that available as SB 51-1/T, SBL 50 and SB 53-2/T from Merz Verpackungmaschinen GmBH. G.D SpA out of Italy also supplies tobacco pouching equipment. Snus pouches can be provided as individual pouches, or a plurality of pouches and can be connected or linked together (e.g., in an end-to-end manner) such that a single pouch or individual portion can be readily removed for use from a one-piece strand or matrix of pouches.

The shape of the outer surface of the containers of the disclosure can vary. Although the container embodiments illustrated in the drawings have certain contours, containers with other exterior surface designs could also be used. For example, the sides or edges of the containers of the disclosure could be flattened, rounded, or beveled, and the various surfaces or edges of the container exterior could be concave or convex. Further, the opposing sides, ends, or edges of the container can be parallel or non-parallel such that the container becomes narrower in one or more dimensions.

The dimensions of the containers described herein can vary without departing from the disclosure. However, in preferred embodiments, the containers of the disclosure can be described as having a cylindrical size suitable for handheld manipulation and operation. Exemplary dimensions for such handheld cylindrical embodiments include diameters in the range of about 50 mm to about 100 mm, and more typically about 60 mm to about 80 mm. Exemplary wall thicknesses include the range of about 0.5 mm to about 1.5 mm, and more typically about 0.8 mm to about 1.4 mm. Exemplary depths for handheld container embodiments of the present disclosure range from about 5 mm to about 50 mm, more typically about 8 mm to about 30 mm, and most often about 15 mm to about 25 mm. An exemplary general outward appearance of the container is that used for commercially available GRIZZLY and KODIAK products that are marketed by American Snuff Company, LLC.

The number of solid product units stored in the containers of the disclosure can also vary, depending on the size of the container and the size of the product units. Typically, the number of stored product units will vary from about 5 to about 100, more typically about 10 to about 50, and most often about 15 to about 30.

FIGS. 1-4 illustrate one container embodiment 10 in accordance with the present disclosure. The container 10 may be formed by an open-ended body 20 and a cover 40. The body 20 has a bottom wall 22 (see FIG. 2), which, in some instances, may be substantially planar, and a side wall 24 depending from the bottom wall 22 which, in some instances, may be cylindrical as shown. The side wall 24 defines a peripheral portion of the container 10 such that the side wall 24 includes an outer peripheral surface 28. The bottom wall 22 and the side wall 24 cooperate to define an internal storage compartment 26 for storage of a plurality of units of a product. In some instances, an upper portion 30 of the side wall 24 may define a lip 32 in such a manner that the upper portion 30 the side wall has a neck region 34 of reduced diameter (as compared to the diameter of the remainder of the outer surface of the side wall). Note that the location of the lip 32 along the side wall 24 of the body 20 can vary without departing from the present disclosure, meaning that distance between the lip 32 and the top edge 38 of the body 20 is not critical to the present disclosure.

The cover 40 may be provided for enclosing the units of product within the internal storage compartment 26. In this regard, the cover 40 is typically removably secured to the body 20 by a snap-fit or an interference fit. As shown in FIG. 1, the cover 40 has a top wall 42, which, in some instances, may be substantially planar, and a peripheral flange 44 depending from the top wall 42 which, in some instances, may be cylindrical. The peripheral flange 44 of the cover 40 is received over the side wall 24 of the body 20 so as to form an enclosure therebetween. The peripheral flange 44 includes a substantially flat or smooth inner surface 50 (FIG. 4). That is, the inner surface 50 typically does not include any protrusions, projections, ribs, or the like for interacting with the outer peripheral surface 28 of the side wall 24 of the body 20. In this regard, the inner surface 50 is substantially smooth and continuous about the cylindrical configuration thereof. In instances where the lip 32 is provided on the body 20, an edge 46 of the peripheral flange 44 may interact with a surface 36 of the lip 32 to form a stop when the cover 40 is received upon the body 20. In other words, the edge 46 of the cover 40, which is typically substantially planar, will abut the surface 36 of the lip 32, which is also typically substantially planar, when the cover 40 is fully seated upon the body 20. A cylindrical outer surface 48 of the cover 40 will typically have the same approximate size or diameter as the side wall 24 of the body 20 such that the cover and body form a smooth exterior surface when the cover is placed over the neck region 34 of the side wall and fully seated upon the body. Hence, the container 10 may be compact and flat so as to be suitable for storage and transportation by a user.

The material of construction of the container 10 can vary. Exemplary materials include metal, wood, and synthetic plastic materials. Polymeric materials that can be extruded and/or molded into desired shapes are typically utilized, such as polyethylene, polystyrene, polyamide, and the like. In a preferred embodiment, the body 20 is formed from a polymeric material, while the cover 40 is formed from a metallic material such as, for example, aluminum or tinplate. Such a configuration is advantageous in that it provides an aesthetically appealing appearance by using a metallic cover 40 (which is typically stamped), while also allowing the body to be less expensively produced using, for example, an injection molding process. In this manner, a rib structure (as further described below) may be more easily and less expensively applied to the body 20 (i.e., via plastic injection molding instead of metallic stamping). Exemplary covers formed from metallic materials are those used for commercially available CAMEL Snuff, GRIZZLY and KODIAK products that are marketed by American Snuff Company, LLC. Exemplary bodies are those that incorporate polymeric materials such as those types of materials used for the same products.

As particularly shown in FIGS. 2 and 3, projecting from the outer peripheral surface 28 of the body 20 (and, when provided, the neck region 34) is a circumferential rib structure 60 configured to form a seal with the cover 40. In some aspects, the rib structure may be integrally formed with the side wall 24 of the body 20, such as, for example, when the body 20 is formed by a plastic injection molding process. In other instances, the rib structure 60 may be a separate and discrete component secured or otherwise affixed to the side wall 24 with appropriate mechanical fasteners or adhesive (e.g., an epoxy adhesive). According to some aspects of the present disclosure, the rib structure 60 may be formed by a plurality of rib segments 62 arranged in spaced relation around the periphery of the side wall 24 of the body 20 (e.g., positioned circumferentially about the side wall 24 of the body 20 where the container body is cylindrical). Any number of rib segments 62 may be provided in accordance with the present disclosure (e.g., about 2 to about 20 rib segments or about 5 to about 15 rib segments), although a preferred embodiment includes twelve such rib segments.

Each rib segment 62 is separated from the next adjacent rib segment 62 by a vent channel 64. Each rib segment 62 may include a rib wall 66 and a rib projection 68. In some instances, as shown in FIG. 3, the rib projection 68 may extend along the entire width of an end of the rib wall 66 disposed proximate to the open end of the body 20. The rib walls 66 have a thickness so as to extend from the outer peripheral surface 28 in such a manner that the lateral ends thereof form the vent channels 64 between adjacent rib segments 62. In other words, each rib segment 62 is raised in comparison to the adjacent exterior surface 28 of the side wall 24 such that channels are formed between the rib segments. When the cover 40 is engaged with the body 20, each pair of adjacent rib segments 62 forms a vent channel 64 therebetween that allows venting from the interior of the container 10 to the atmosphere exterior of the container, the vent channels extending between the top edge 38 of the side wall 24 downwardly past rib segments 62 to the lip 32. Such vent channels 64 provide proper venting when the cover 40 is fully seated on the body 20.

In some instances, the rib structure 60 may be positioned adjacent to the lip 32, wherein the top edge 38 of the side wall 24 can engage the surface 36 of the lip 32 in such a manner that the outer peripheral surface 28 of the body 20 is substantially flush with the outer surface 48 of the cover 40. In other words, in some instances, the peripheral flange 44 of the cover 40 may not be deflected by the rib structure 60 to such a degree that causes the peripheral flange 44 to extend beyond the lip 32.

The rib projections 68 project radially outward from the outer peripheral surface 28 and the neck region 34 (when provided). Although the rib projections 38 are shown in spaced relation to the top edge 38 of the body 20, the position of the rib projections may vary in relation to the top edge, meaning the rib projection could be moved closer or further away from the top edge without departing from the present disclosure. In some instances, the rib projections 68 have a substantially arcuate or rounded profile, although other configurations may also be employed, such as, for example, a configuration in which the rib projection 68 terminates at a substantially sharp edge (not shown) outward of the outer peripheral surface 28. As shown in FIG. 4, the rib projections 68 interact with the peripheral flange 44 of the cover 40 in an interference fit when the cover is positioned over the side wall 24 of the body 20, so as to form a seal therebetween. In this regard, the rib projections 68 force the peripheral flange 44 outward of the outer peripheral surface 28 to form a tight interference fit when the cover 40 is engaged with the body 20.

Exemplary dimensions for the rib projections 62 include heights in the range of about 0.05 millimeters to about 0.25 millimeters, and widths in the range of about 1 millimeter to about 1.5 millimeters. As used herein, height refers to the major dimension of the rib projection that extends from the outer peripheral surface 28, as indicated by reference character A (FIG. 4). Rib projections 62 may be positioned below the top edge 38 of side wall 24 in the range of about 1.5 millimeters to about 2.0 millimeters below the top edge. Exemplary dimensions for the vent channels 64 include heights in the range of about 6.9 millimeters to about 7.2 millimeters, and depths in the range of about 0.1 millimeters to about 0.2 millimeters.

As part of the final packaging process, once the containers of the disclosure are filled with the desired product, the containers can be sealed with a circumferential label or wrapper of a pervious or impervious material. The label or wrapping material useful in accordance with the present disclosure can vary. Typically, the selection of the packaging label or wrapper is dependent upon factors such as aesthetics, desired barrier properties (e.g., so as to provide protection from exposure to oxygen, or so as to provide protection from loss of moisture), or the like.

Many modifications and other aspects of the disclosure set forth herein will come to mind to one skilled in the art to which the disclosure pertains having the benefit of the teachings presented in the foregoing descriptions and the associated drawings. Therefore, it is to be understood that the disclosure is not to be limited to the specific aspects disclosed and that modifications and other aspects are intended to be included within the scope of the appended claims. Although specific terms are employed herein, they are used in a generic and descriptive sense only and not for purposes of limitation.

That which is claimed:

1. A container, comprising: a body having a bottom wall and a side wall, the bottom wall and the side wall defining an internal storage compartment adapted for storage of a plurality of units of a product, a portion of the side wall having an outer peripheral surface, wherein the outer peripheral surface of the portion of the side wall lies along a vertical plane, and extends from a lip to a top edge of the side wall; a rib structure operably engaged with the body about the outer peripheral surface of the side wall and extending outwardly therefrom; and a cover configured to be removably engaged with the body, the cover having a top wall and a peripheral flange having an inner surface, the inner surface being substantially smooth and configured to interact with the rib structure when the cover is received over the outer peripheral surface of the side wall so as to form an interference fit, wherein the rib structure comprises a plurality of rib segments projecting from the outer peripheral surface of the side wall, the rib segments being completely spaced apart so as to form vent channels therebetween for facilitating venting when the cover is received over the body, and wherein each rib segment comprises: a rib wall projecting radially outwardly relative to a center of the body from the side wall and defining a rib wall surface that is radially displaced relative to the center of the body from the outer peripheral surface of the side wall, the rib wall lying in a vertical plane parallel to the vertical plane in which the outer peripheral surface of the portion of the side wall extending from the lip to the top edge lies; and a rib projection defining a top end of the rib wall and projecting radially outwardly relative to the center of the body, the rib projection including a first surface extending from the side wall, a second surface extending from the rib wall surface, and an outer edge extending between the first surface and the second surface, the outer edge being radially displaced relative to the center of the body beyond the rib wall surface and configured to interact with the inner surface of the peripheral flange when the cover is received over the outer peripheral surface of the side wall, wherein the rib wall extends from the rib projection to a substantially planar surface of the lip, the substantially planar surface of the lip extending substantially perpendicularly from the rib wall surface around a perimeter of the body.

2. The container of claim 1, wherein the body is comprised of a polymeric material, and the cover is comprised of a metallic material.

3. The container of claim 2, wherein the rib structure is integrally formed with the side wall of the body.

4. The container of claim 1, wherein the cover interacts with the lip to form a stop when the cover is received over the outer peripheral surface of the side wall.

5. The container of claim 4, wherein the peripheral flange comprises a substantially planar edge configured for abutting contact with the substantially planar surface of the lip when the cover is fully seated upon the body.

6. The container of claim 1, wherein the side wall and the peripheral flange are substantially cylindrical, and the rib structure extends circumferentially about the outer peripheral surface of the side wall.

7. The container of claim 1, wherein the rib projections extend outwardly of the outer peripheral surface between about 0.05 millimeters and about 0.25 millimeters.

8. The container of claim 1, wherein the internal storage compartment comprises a plurality of products.

9. The container of claim 8, wherein the product is one of smoking products and smokeless tobacco products.

10. A container, comprising: a polymeric body having a bottom wall and a cylindrical side wall, the bottom wall and the side wall defining an internal storage compartment adapted for storage of a plurality of units of a product, a portion of the side wall having an outer peripheral surface, wherein the outer peripheral surface of the portion of the side wall lies along a vertical plane, and extends from a lip to a top edge of the side wall; a circumferential rib structure integrally formed with the polymeric body about the outer peripheral surface of the side wall and extending radially outwardly therefrom relative to a center of the polymeric body, the rib structure comprising a plurality of rib segments extending circumferentially about the outer peripheral surface of the side wall, the rib segments being completely spaced apart so as to form vent channels therebetween; and a metallic cover configured to be removably engaged with the polymeric body, the metallic cover having a top wall and a peripheral flange having a cylindrical inner surface, the cylindrical inner surface being substantially smooth and configured to interact with the rib structure when the metallic cover is received over the outer peripheral surface of the side wall so as to form an interference fit, wherein each rib segment comprises: an arcuate rib wall projecting radially outwardly relative to the center of the polymeric body from the side wall and defining a rib wall surface that is radially displaced relative to the center of the polymeric body from the outer peripheral surface of the side wall, the arcuate rib wall lying in a vertical plane parallel to the vertical plane in which the outer peripheral surface of the portion of the side wall extending from the lip to the top edge lies; and an arcuate rib projection defining a top end of the arcuate rib wall and projecting radially outwardly relative to the center of the polymeric body, the arcuate rib projection including a first surface extending from the side wall, a second surface extending from the rib wall surface, and an outer edge extending between the first surface and the second surface, the outer edge being radially displaced relative to the center of the polymeric body beyond the rib wall surface and configured to interact with the inner surface of the peripheral flange when the metallic cover is received over the outer peripheral surface of the side wall, wherein the rib wall extends from the rib projection to a substantially planar surface of the lip, the substantially planar surface of the lip extending substantially perpendicularly from the rib wall surface around a perimeter of the polymeric body.

11. The container of claim 10, wherein the lip extends circumferentially about the outer peripheral surface, the peripheral flange of the metallic cover interacting with the lip to form a stop when the cover is received over the outer peripheral surface of the side wall.

12. The container of claim 11, wherein the peripheral flange comprises a substantially planar edge configured for abutting contact with the substantially planar surface of the lip when the metallic cover is fully seated upon the polymeric body.

13. The container of claim 10, wherein the arcuate rib projections extend outwardly of the outer peripheral surface between about 0.05 millimeters and about 0.25 millimeters.

14. The container of claim 10, wherein the internal storage compartment comprises a plurality of products.

15. The container of claim 14, wherein the product is one of smoking products and smokeless tobacco products.

16. A container, comprising: a polymeric body having a bottom wall and a cylindrical side wall having an edge, the bottom wall and the side wall defining an internal storage compartment adapted for storage of a plurality of units of a product, the internal storage compartment having an opening thereto adjacent to the edge of the side wall, wherein an outer peripheral surface of a portion of the side wall comprises a neck region of reduced diameter proximal to the edge of the side wall such that the side wall defines a lip, the outer peripheral portion lying along a vertical plane, and extending from the lip to a top edge of the side wall; a circumferential rib structure integrally formed with the polymeric body about the outer peripheral surface of the side wall in the neck region and projecting radially outwardly therefrom relative to a center of the polymeric body, the rib structure comprising a plurality of rib segments extending circumferentially about the outer peripheral surface of the side wall, the rib segments being completely spaced apart so as to form vent channels therebetween and each rib segment comprising a rib wall projecting radially outwardly relative to the center of the polymeric body from the outer peripheral surface of the polymeric body and defining a rib wall surface that is radially displaced relative to the center of the polymeric body from the outer peripheral surface of the side wall and a rib projection defining a top end of the rib wall and projecting radially outwardly relative to the center of the polymeric body, the rib wall lying in a vertical plane parallel to the vertical plane in which the outer peripheral surface of the portion of the side wall extending from the lip to the top edge lies, the rib projection including a first surface extending from the side wall, a second surface extending from the rib wall surface, and an outer edge extending between the first surface and the second surface, the outer edge being radially displaced relative to the center of the polymeric body beyond the rib wall surface, each vent channel at least partially defined by adjacent rib walls and the outer peripheral surface of the side wall of the polymeric body; and a metallic cover configured to be removably engaged with the polymeric body, the metallic cover having a top wall and a peripheral flange having a cylindrical inner surface, the cylindrical inner surface being substantially smooth and configured to interact with the rib structure when the metallic cover is received over the neck region of the side wall so as to form an interference fit, and wherein the metallic cover is configured to abut the lip of the side wall of the polymeric body when the metallic cover is fully seated on the polymeric body, wherein the rib wall extends from the rib projection to a substantially planar surface of the lip, the substantially planar surface of the lip extending substantially perpendicularly from the rib wall surface around a perimeter of the polymeric body.

* * * * *